US009108817B1

(12) United States Patent
Muir et al.

(10) Patent No.: US 9,108,817 B1
(45) Date of Patent: Aug. 18, 2015

(54) WEB GUIDING STRUCTURE WITH CONTINUOUS SMOOTH RECESSES

(71) Applicants: Christopher M. Muir, Rochester, NY (US); Randy Eugene Armbruster, Rochester, NY (US); Bonnie J. Patterson, Rochester, NY (US); W. Charles Kasiske, Jr., Webster, NY (US)

(72) Inventors: Christopher M. Muir, Rochester, NY (US); Randy Eugene Armbruster, Rochester, NY (US); Bonnie J. Patterson, Rochester, NY (US); W. Charles Kasiske, Jr., Webster, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/222,699

(22) Filed: Mar. 24, 2014

(51) Int. Cl.
*B41J 2/01* (2006.01)
*B65H 23/04* (2006.01)
*B41J 15/04* (2006.01)

(52) U.S. Cl.
CPC *B65H 23/04* (2013.01); *B41J 15/04* (2013.01)

(58) Field of Classification Search
CPC ..... B65H 23/025; B41J 11/00
See application file for complete search history.

(56) References Cited

U.S. PATENT DOCUMENTS

| | | | |
|---|---|---|---|
| 5,611,275 | A | 3/1997 | Iijima et al. |
| 6,984,412 | B2 | 1/2006 | Tanaka |
| 8,303,106 | B2 | 11/2012 | Kasiske et al. |
| 8,303,107 | B2 | 11/2012 | Kasiske et al. |
| 2010/0054826 | A1 | 3/2010 | Hieda |
| 2012/0223117 | A1 | 9/2012 | Kasiske, Jr. et al. |
| 2012/0223118 | A1 | 9/2012 | Piatt et al. |

*Primary Examiner* — Julian Huffman
(74) *Attorney, Agent, or Firm* — Kevin E. Spaulding

(57) ABSTRACT

A web-guiding system for guiding a web of media travelling from upstream to downstream along a transport path in an in-track direction. A web-guiding structure includes an exterior surface having a pattern of alternating ridges and recesses formed into the exterior surface. The web of media travels past the web-guiding structure with the first side of the web of media contacting at least some of the ridges on the exterior surface of the web-guiding structure. The ridges and recesses are formed into the exterior surface of the web-guiding structure such that the exterior surface has a continuous and smooth surface profile in the cross-track direction having a specified maximum slope magnitude and a specified minimum radius of curvature magnitude.

18 Claims, 14 Drawing Sheets

WEB GUIDING STRUCTURE WITH CONTINUOUS SMOOTH RECESSES

CROSS REFERENCE TO RELATED APPLICATIONS

Reference is made to commonly assigned, co-pending U.S. patent application Ser. No. 14/016,427, entitled "Positive pressure web wrinkle reduction system," by Kasiske Jr., et al.; to commonly assigned, co-pending U.S. patent application Ser. No. 14/016,440, entitled "Negative pressure web wrinkle reduction system" by Kasiske et al.; and to commonly assigned, co-pending U.S. patent application Ser. No. 14/190,125, entitled "Media-guiding system using Bernoulli force roller" by Muir et al., each of which is incorporated herein by reference.

FIELD OF THE INVENTION

This invention pertains to the field of media transport and more particularly to an apparatus for guiding a web of receiver media using a web-guiding structure having a pattern of alternating ridges and recesses to reduce wrinkle artifacts caused by media expansion.

BACKGROUND OF THE INVENTION

In a digitally controlled inkjet printing system, a receiver media (also referred to as a print medium) is conveyed past a series of components. The receiver media can be a cut sheet of receiver media or a continuous web of receiver media. A web or cut sheet transport system physically moves the receiver media through the printing system. As the receiver media moves through the printing system, liquid (e.g., ink) is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can also adversely affect image quality.

FIG. 1 illustrates a type of distortion of a receiver media 3 that can occur during an inkjet printing process. As the receiver media 3 absorbs the water-based inks applied to it, the receiver media 3 tends to expand. The receiver media 3 is advanced through the system in an in-track direction 4. The perpendicular direction, within the plane of the un-deformed receiver media, is commonly referred to as the cross-track direction 7. Typically, as the receiver media 3 expands (or contracts) in the cross-track direction 7, contact between the receiver media 3 and contact surface 8 of rollers 2 (or other web guiding components) in the inkjet printing system can produce sufficient friction such that the receiver media 3 is not free to slide in the cross-track direction 7. This can result in localized buckling of the receiver media 3 away from the rollers 2 to create lengthwise flutes 5, also called ripples or wrinkles, in the receiver media 3. Wrinkling of the receiver media 3 during the printing process can lead to permanent creases in the receiver media 3 which adversely affects image quality.

U.S. Pat. No. 5,611,275 to Iijima et al., entitled "Width adjusting device and method for a paper web," describes a device for adjusting the width of a paper web travelling through a print. The paper web is sandwiched between a pair of rollers having a plurality of contact surfaces which are arranged in an interleaved pattern. As the rollers are moved toward each other, the paper web is subjected to contacting pressure and is deformed to form a wavy surface, thereby decreasing the primary width of the paper web.

U.S. Patent Application Publication 2010/0054826 to Hieda, entitled "Web transfer method and apparatus," discloses a web control system that includes a tiered roller and a pair of nip rollers. The tiered roller is formed to have a larger diameter at both ends than in a central portion. The nip rollers are arranged to incline outward to spread the web as it passes between the tiered roller and the nip rollers.

There remains a need for a means to prevent the formation of receiver media wrinkles as a receiver media contacts web-guiding structures in a digital printing system.

SUMMARY OF THE INVENTION

The present invention represents a web-guiding system for guiding a web of media having a width spanning a cross-track direction travelling from upstream to downstream along a transport path in an in-track direction, the web of media having a first side and an opposing second side, comprising:

a web-guiding structure including an exterior surface having a pattern of alternating ridges and recesses formed into the exterior surface, wherein the web of media travels past the web-guiding structure with the first side of the web of media contacting at least some of the ridges on the exterior surface of the web-guiding structure;

wherein the ridges and recesses are formed into the exterior surface of the web-guiding structure such that the exterior surface has a continuous and smooth surface profile in the cross-track direction, the surface profile having a maximum slope magnitude of no more than 0.3 and a minimum radius of curvature magnitude of no less than 5 mm.

This invention has the advantage that the recesses in the exterior surface of the web-guiding structure are adapted to accommodate expansion of the receiver media as a result of absorbing moisture content.

It has the additional advantage that the continuous and smooth surface profile eliminates any sharp edges or high-slope surfaces that can be a source for forming receiver media wrinkles.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
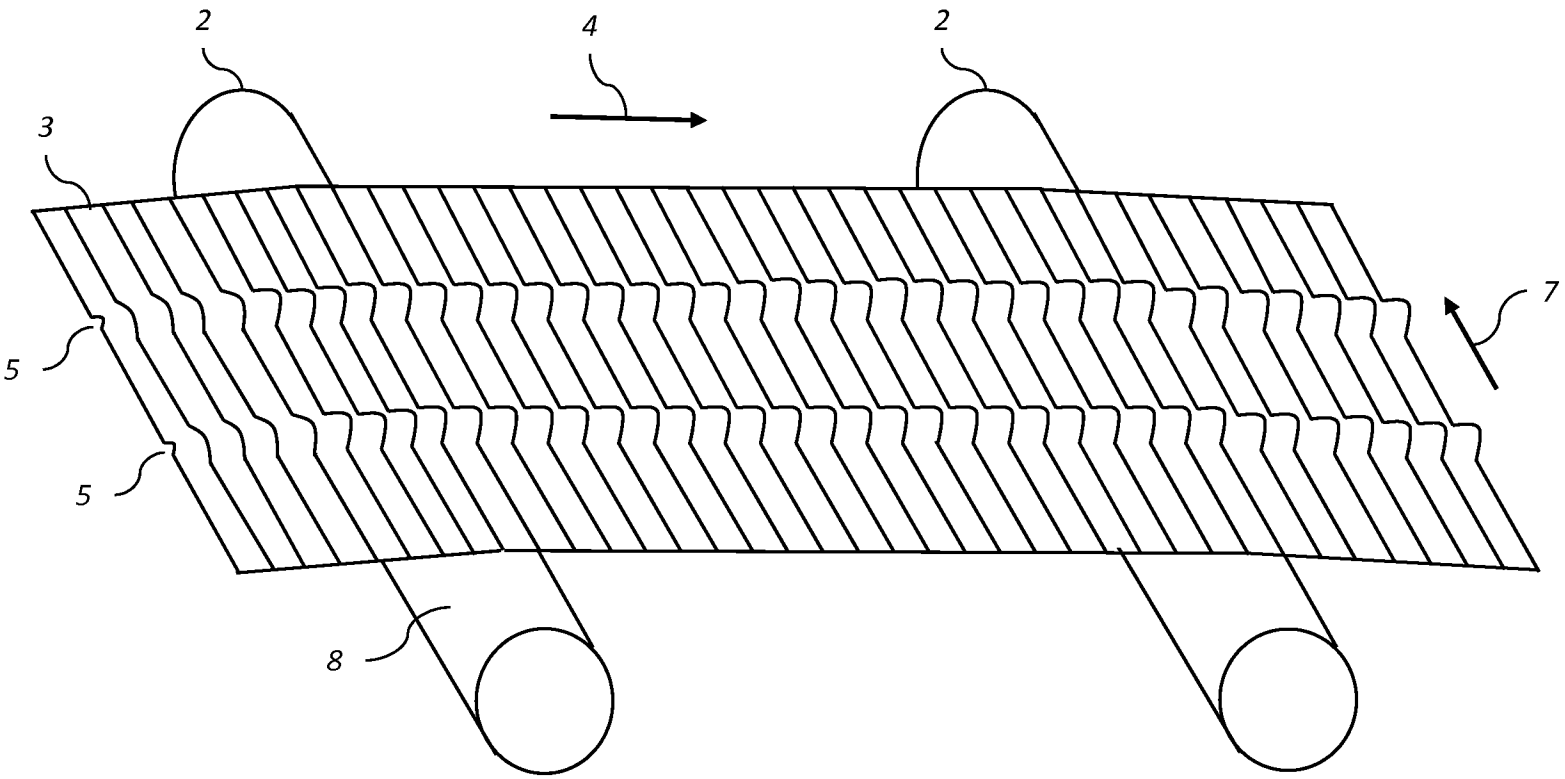
FIG. 1 (Prior Art)
FIG. 1 illustrates the formation of flutes in a continuous web of receiver media due to cross-track expansion of the receiver media.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and may not be to scale for the sake of clarity. One of ordinary skill in the art will be able to readily determine the specific size and interconnections of the elements of the example embodiments of the present invention.

As described herein, the exemplary embodiments of the present invention provide receiver media guiding components useful for guiding the receiver media in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard and corrugated cardboard can comprise the receiver media. Additionally, although the term "inkjet" is often used to describe printing processes, it can also be used to describe other processes that involve the non-contact application of ink, or other liquids, to a receiver media in a consistent, metered fashion, particularly if the desired result is a thin layer or coating. Typically, ink jetting mechanisms can be categorized as either drop-on-demand inkjet printing or continuous inkjet printing.

Drop-on-demand inkjet printing provides ink drops that impact upon a recording surface using a pressurization actuator, for example, a thermal, piezoelectric or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal inkjet." A second commonly practiced drop-on-demand inkjet type uses piezoelectric actuators to change the volume of an ink chamber to eject an ink drop.

The second technology commonly referred to as "continuous" inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become printing drops and non-printing drops. Printing occurs by selectively deflecting either the printing drops or the non-printing drops and catching the non-printing drops using catchers. Various approaches for selectively deflecting drops have been developed including electrostatic deflection, air deflection, and thermal deflection.

There are typically two types of receiver media used with inkjet printing systems. The first type of receiver media is in the form of a continuous web, while the second type of receiver media is in the form of cut sheets. The continuous web of receiver media refers to a continuous strip of receiver media, generally originating from a source roll. The continuous web of receiver media is moved relative to the inkjet printing system components using a web transport system, which typically includes drive rollers, web guide rollers, and web tension sensors. Cut sheets refer to individual sheets of receiver media that are moved relative to the inkjet printing system components via rollers and drive wheels or via a conveyor belt system that is routed through the inkjet printing system.

The invention described herein is applicable to both drop-on-demand and continuous inkjet printing technologies that print on continuous webs of receiver media. As such, the term "printhead" as used herein is intended to be generic and not specific to either technology. Additionally, the invention described herein is also applicable to other types of printing systems, such as offset printing and electrophotographic printing, that print on continuous webs of receiver media.

The terms "upstream" and "downstream" are terms of art referring to relative positions along the transport path of the receiver media; points on the receiver media move along the transport path from upstream to downstream.

Figure 2:
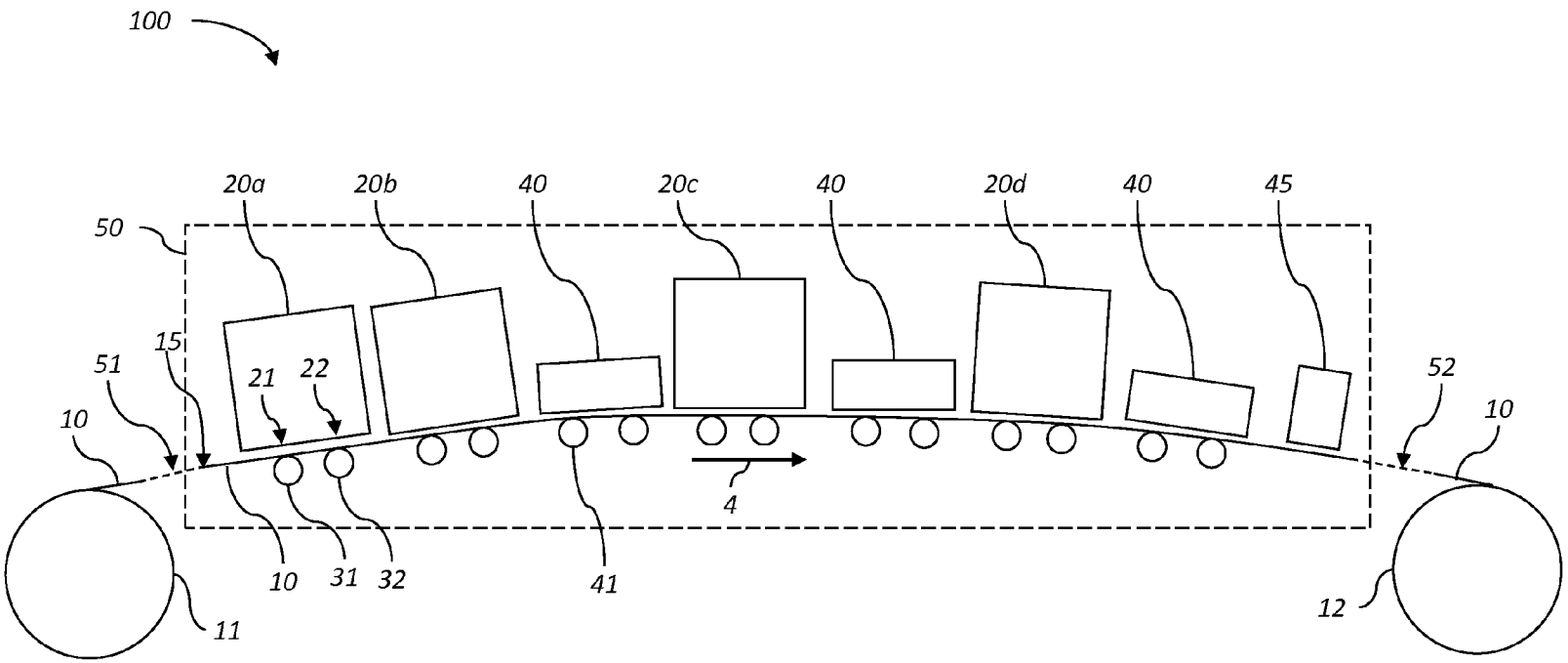
FIG. 2 is a simplified side view of an inkjet printing system.

Referring to FIG. 2, there is shown a simplified side view of a portion of a digital printing system 100 for printing on a first side 15 of a continuous web of receiver media 10. The printing system 100 includes a printing module 50 which includes printheads 20*a*, 20*b*, 20*c*, 20*d*, dryers 40, and a quality control sensor 45. In this exemplary system, the first printhead 20*a* jets cyan ink, the second printhead 20*b* jets magenta ink, the third printhead 20*c* jets yellow ink, and the fourth printhead 20*d* jets black ink.

Below each printhead 20*a*, 20*b*, 20*c*, 20*d* is a media guide assembly including print line rollers 31 and 32 that guide the continuous web of receiver media 10 past a first print line 21 and a second print line 22 as the receiver media 10 is advanced along a media path in the in-track direction 4. Below each dryer 40 is at least one dryer roller 41 for controlling the position of the web of receiver media 10 near the dryers 40.

Receiver media 10 originates from a source roll 11 of unprinted receiver media 10, and printed receiver media 10 is wound onto a take-up roll 12. Other details of the printing module 50 and the printing system 100 are not shown in FIG. 2 for simplicity. For example, to the left of printing module 50, a first zone 51 (illustrated as a dashed line region in receiver media 10) can include a slack loop, a web tensioning system, an edge guide and other elements that are not shown. To the right of printing module 50, a second zone 52 (illustrated as a dashed line region in receiver media 10) can include a turnover mechanism and a second printing module similar to printing module 50 for printing on a second side of the receiver media 10.

Figure 3:
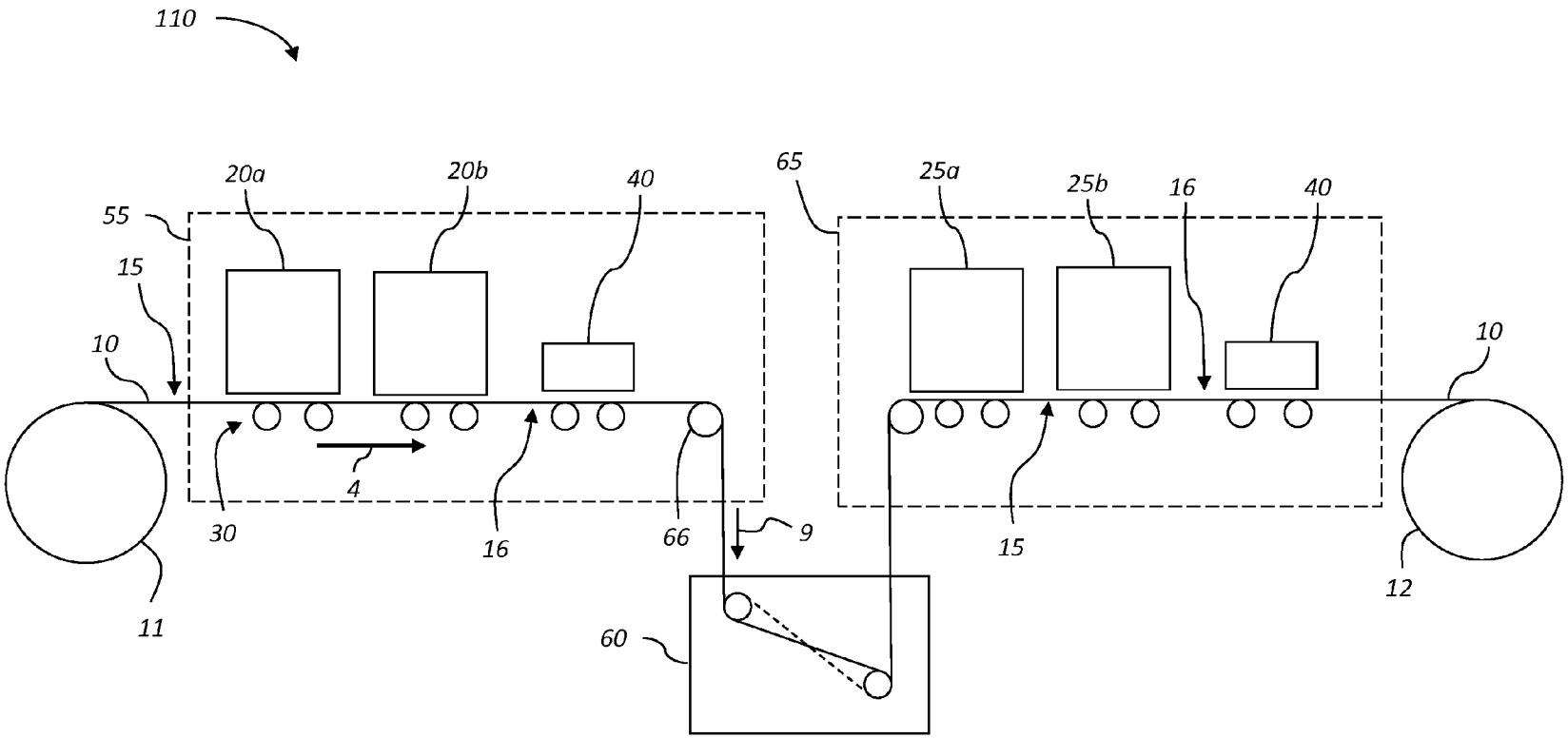
FIG. 3 is a simplified side view of an inkjet printing system for printing on both sides of a web of receiver media.

Referring to FIG. 3, there is shown a simplified side view of a portion of a printing system 110 for printing on both a first side 15 and a second side 16 of a continuous web of receiver media 10. Printing system 110 includes a first printing module 55, for printing on a first side 15 of the continuous web, having two printheads 20*a*, 20*b* and a dryer 40; a turnover mechanism 60; and a second printing module 65, for printing on the second side of the continuous web, having two printheads 25*a* and 25*b* and a dryer 40. A web-guiding system 30 guides the web of receiver media 10 from upstream to downstream along a transport path in an in-track direction 4 past through the first printing module 55 and the second printing module 65. The web-guiding system 30 includes rollers aligned with the print lines of the printheads 20*a*, 20*b*, 25*a*, and 25*b*. These rollers maintain the receiver media 10 at a fixed spacing from the printing modules to ensure a consistent time of flight for the print drops emitted by the printheads. The web-guiding system 30 also includes a web-guiding structure 66, which can be a roller for example, positioned near the exit of first printing module 55 for redirecting a direction of travel of the web of receiver media 10 along exit direction 9 in order to guide web of receiver media 10 toward the turnover mechanism 60. The movement of the receiver media of the guiding rollers of the web guide system also maintains the cross-track position of the continuous web provided there is sufficient traction between the continuous web and the guiding rollers.

Figure 4:
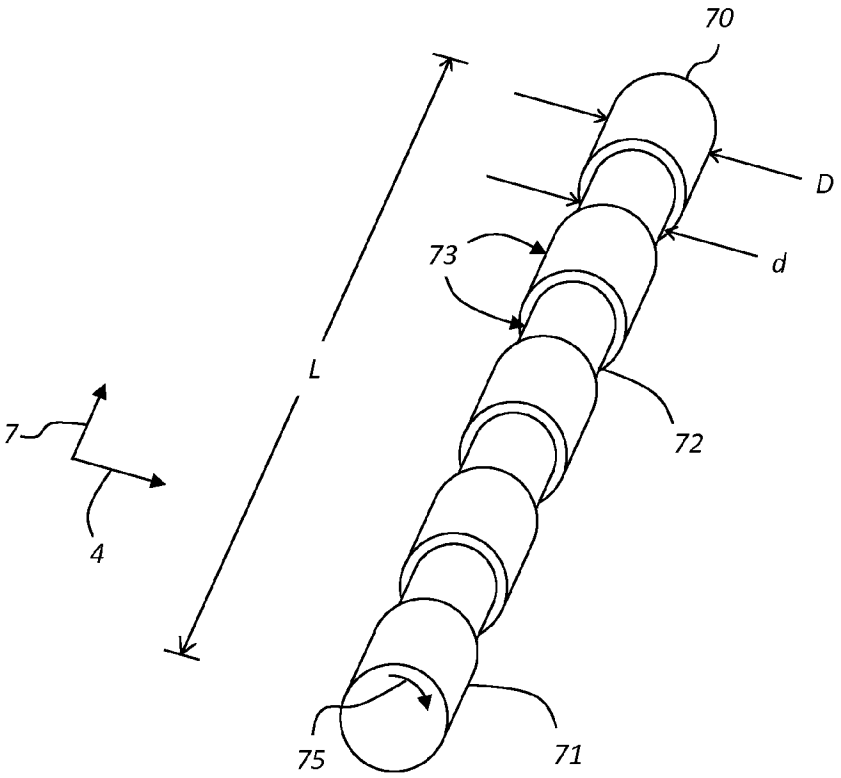
FIG. 4 (Prior Art)
FIG. 4 is a perspective diagram of a web-guiding structure having ridges and recesses.

Commonly assigned, U.S. Pat. No. 8,303,106 to C. Kasiske et. al., entitled "Printing system including web media moving apparatus", which is incorporated herein by reference, discloses a roller for use as a web-guiding structure having a pattern of recesses and ridges positioned along its axis of rotation. FIG. 4 shows a perspective of an example of a web-guiding structure 70 similar to that described in U.S. Pat. No. 8,303,106 having ridges 71 and recesses 72 alternately disposed along its length. The web-guiding structure 70 extends along a length L that is parallel to cross-track direction 7 and provides a curved exterior surface 73 having a cylindrical shape. The diameter of the exterior surface 73 of web-guiding structure 70 varies along length L to form the pattern of ridges 71 and recesses 72. In particular, the diameter of exterior surface 73 at a ridge 71 is D, and the diameter of exterior surface 73 at a recess 72 is d, where d<D. In this example, each recess 72 is a groove in the web-guiding structure 70, where the grooves extend around at least a portion of the exterior surface 73 and are parallel to the in-track direction 4. The grooves that form the recesses 72 can be equally spaced or non-equally spaced.

In some embodiments, the web-guiding structure 70 is a roller that rotates in rotation direction 75, either being driven by a motor (not shown) or being passively rotated by the web moving in contact with the exterior surface 73 of the web-guiding structure 70, and particularly the exterior surface 73 of the ridges 71. The recesses 72 provide regions for the web of receiver media 10, which has undergone dimensional changes due to ink deposition by printheads 20*a*, 20*b*, 20*c*, 20*d* and by dryers 40 (FIG. 3), to fit into as web of receiver media 10 wraps around web-guiding structure 70. This reduces the likelihood of the receiver media 10 wrinkling as it wraps around web-guiding structure 70.

Figure 5A:
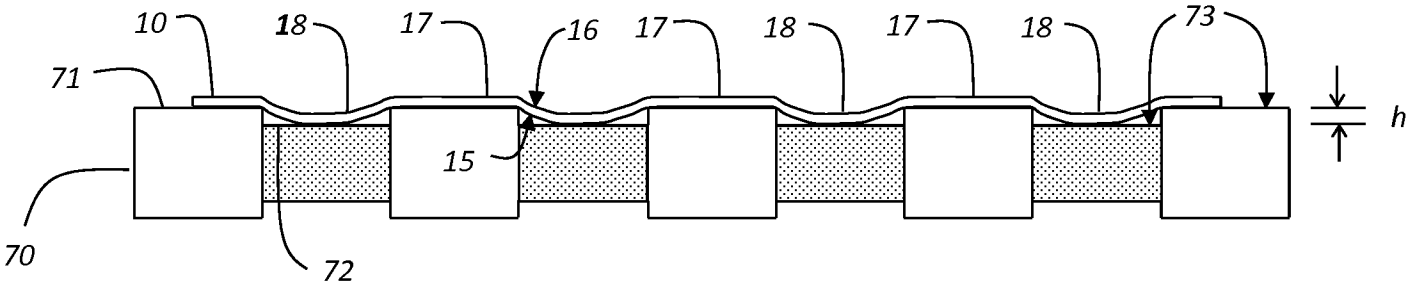
FIG. 5A (Prior Art)
FIG. 5A is a side view of a web-guiding structure where portions of the web of receiver media extend into recesses in the web-guiding structure.

FIG. 5A shows a side view of web-guiding structure 70 where some receiver media portions 17 are in contact with the exterior surface 73 of the ridges 71, and other receiver media portions 18 extend into the recesses 72. The extent to which the receiver media portions 18 can be accommodated in the recesses 72 is limited by the first side 15 of the receiver media 10 contacting the bottoms (i.e., the exterior surfaces 73) of recesses 72, which is related to the depth h of recesses 72.

Figure 5B:
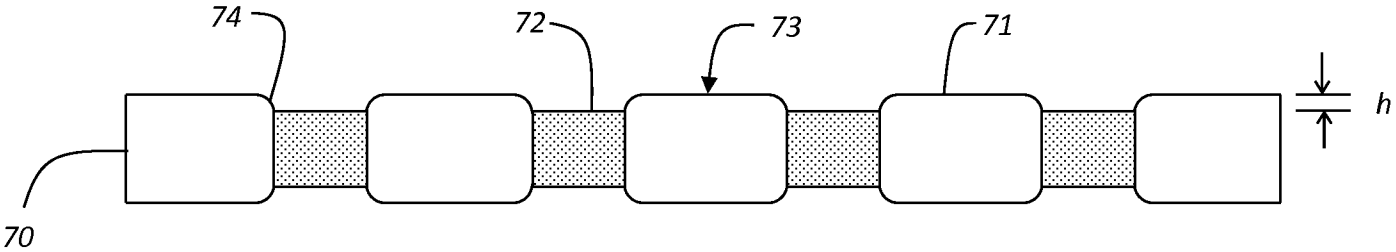
FIG. 5B (Prior Art)
FIG. 5B is a side view of a web-guiding structure having ridges with rounded edges.

FIG. 5B shows a side view of a web-guiding structure 70 where the ridges 71 have rounded edges 74 where they meet the recesses 72. Such rounded edges 74 provide a lower concentration of stress on the web of receiver media 10 (FIG. 5A) as it extends into the recesses 72.

Despite the rounded edges of the recesses 72 in the configuration of FIG. 5B, it has been found that this web-guiding structure 70 is still somewhat susceptible to formation of permanent creases in the receiver media 10. The creases are most likely to form in proximity to the relatively sharp corners formed where the vertical edges of the recesses 72 meet the exterior surface 73 of the ridges (i.e., at the rounded edges).

Figure 6:
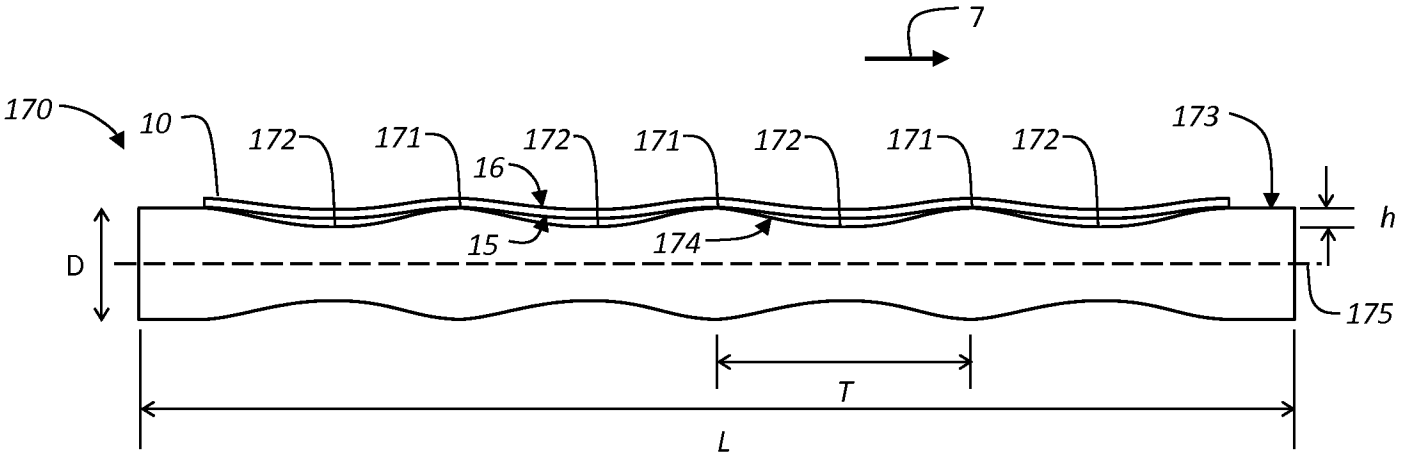
FIG. 6 is a side view of a web-guiding structure having a continuous and smooth surface profile according to an exemplary embodiment.

Inventors have found that the likelihood of forming permanent creases in the receiver media 10 can be significantly reduced by using surface profiles that have no sharp corners, and no steep slope portions. An exemplary web-guiding structure 170 meeting these criteria is shown in FIG. 6. The web-guiding structure 170 in this case is a roller having a length L and an outer diameter D adapted to rotate around a roller axis 175. The web-guiding structure 170 has a surface profile 174 having an alternating pattern of ridges 171 and recesses 172 that is both continuous and smooth in the cross-track direction 7. (In mathematical terms, a function f(x) is said to be continuous within a specified domain if the $\lim_{x \to x_0} f(x) = f(x_0)$ for all $x_0$ within the domain. A smooth function is one where the derivative of the function is continuous within a specified domain.) In this example, the ridges 171 and recesses 172 form a periodic pattern having a period T.

In a preferred embodiment, the slope of the surface profile 174 along the length of the web-guiding structure is constrained to be less than a specified maximum slope value, and the radius of curvature along the length of the web-guiding structure 170 is constrained to be greater than a specified minimum radius of curvature. This ensures that the surface profile 174 has no steep edges or sharp corners. In an exemplary embodiment, the maximum slope value is no more than about 0.3, and the minimum radius of curvature is no less than about 5 mm. Although depending on the characteristics of the receiver media 10 different limiting values may be appropriate.

In a preferred embodiment, the surface profile 174 of the web-guiding structure 170 has a continuously varying slope so that there are no flat portions. However, this is not a requirement. In some embodiments a portion of the surface profile 174 can have a constant slope provided that there are no sudden changes in the slope. For example, a central portion of the recesses 172 could be flat (e.g., horizontal), or a portion of the surface profile 174 in the transition region between the ridges 171 and the recesses 172 could have a constant slope. Generally, at least 50% of the surface profile 174 should have a continuously varying slope.

As the receiver media 10 travels past the web-guiding structure 170, the first side 15 of the receiver media 10 will contact at least some of the ridges 171 on the exterior surface 173 of the web-guiding structure 170. As the receiver media 10 undergoes dimensional changes (e.g., due to wetting of the receiver media 10 as ink is deposited by a printing process), the receiver media 10 will sag into the recesses 172 as shown in FIG. 6. The shape of the surface profile 174 is preferably adapted to conform to the shape of deformations that naturally form in a thin, limp receiver media 10 as the moisture content is increased due to the introduction of ink to the surface. In an exemplary embodiment, the shape of the surface profile 174 is sinusoidal. However, those skilled in the art will recognize that the exact form of the surface profile 174 is not critical to the invention as long as it satisfies the slope and radius of curvature constraints. In other embodiments, the surface profile 174 can take other functional forms. For example, the surface profile 174 can be represented as a Fourier series, or as a piecewise function formed using segments defined using functions such as polynomials or conic section. Alternatively, the surface profile 174 can be defined using a spline function or some other type of interpolating function.

While the surface profile 174 is specified to be "continuous" and "smooth," it should be recognized that these terms refer to a macroscopic scale. It will be recognized by one skilled in the art that the surface profile 174 need not be continuous and smooth on a microscopic scale. For example, some manufacturing processes will produce a surface profile 174 having a surface roughness which may be as large as 10 microns or more. For example, a lathe may produce a surface profile having a series of discrete "steps" corresponding to a sequence of tool positions. Surface roughnesses of less than 10 microns, or less than 10% of the recess depth h, whichever is greater, are understood herein to be within the scope of a "continuous" and "smooth" surface profile. Even a thin, limp receiver media 10 will have generally have sufficient stiffness so that it can bridge across surface features having a surface roughness in this range without contributing to creasing.

Figure 7:
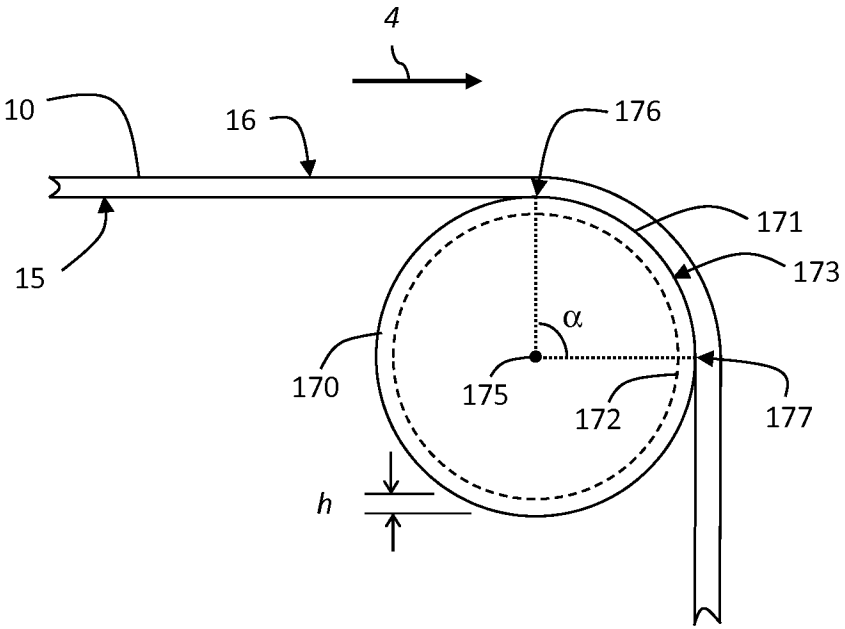
FIG. 7 is an end view of the web-guiding structure of FIG. 6.

FIG. 7 shows an end view of the web-guiding structure 170 of FIG. 6. The web of receiver media 10 is shown wrapping around the web-guiding structure 170 for a wrap angle α. The wrap of the web of receiver media 10 extends from an entry contact boundary 176 to an exit contact boundary 177. The wrap angle α corresponds to the amount of redirection in the direction of travel of the web of receiver media 10 by the web-guiding structure 170. In the illustrated example, the wrap angle α is approximately equal to 90 degrees. (This could correspond to the case where the web-guiding structure 170 is used for the web-guiding structure 66 in FIG. 3.) More generally, the invention is applicable to web-guiding systems where the direction of travel of the web of media is redirected by any amount (e.g., between 1 degree and 200 degrees) as it travels along the transport path past web-guiding structure 170. For example if the web-guiding structure 170 is used for the print line roller 31 in FIG. 2, the wrap angle would be a few degrees or less. Typically, the larger the wrap angle, the more susceptible the receiver media 10 will be to forming wrinkles, and the more the receiver media 10 will conform to the surface profile 174 of the web-guiding structure 170.

In the exemplary web-guiding structure 170 of FIG. 6, the ridges 171 are shown to be equally spaced so that the period T between adjacent ridges 171 is constant. In alternate embodiments (not shown), the ridges 171 can be non-equally spaced. Additionally, the recesses 172 are shown as having equal depths h. In alternate embodiments (not shown), the depth h of the recesses can be varied across the width of the receiver media 10.

The depth of the recesses should be selected so that the path length along the surface is long enough to accommodate the maximum amount of media expansion that is likely to be encountered. For example, it has been found that an exemplary media will expand by about 2 mm over a width of 241 mm (i.e., 0.83%) when the moisture content is increased from 0% to 21%.

Figure 8:
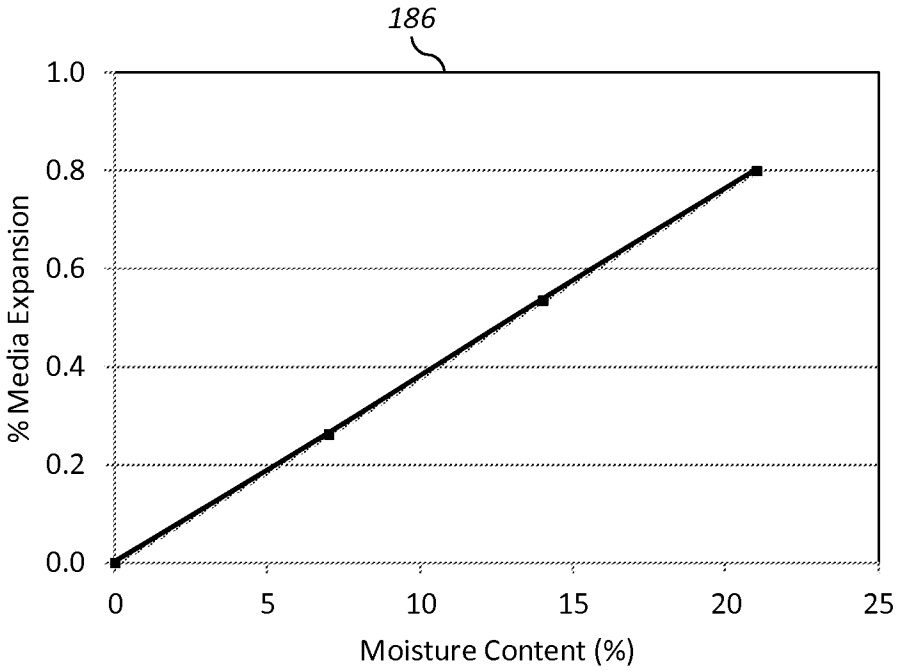
FIG. 8 is a plot of media expansion as a function of moisture content for an exemplary receiver media.

The depth of the recesses 172 should be selected to accommodate the maximum amount of expansion that the receiver media 10 is likely to experience during the operation of the printer. For thin, porous receiver media 10 the amount of expansion can be more than 0.25%. For example, FIG. 8 shows a plot 186 of percent media expansion as a function of percent moisture content (by weight) for a typical receiver media 10 (45 lb matte Utopia Book Inkjet PE coated printing paper available from Appleton Coated LLC of Combined Locks, Wis.). It can be seen that the amount of media expansion is approximately linearly related to the amount of moisture added to the receiver media 10. In an exemplary embodiment, the maximum expected moisture content is 21%, and therefore the recesses 172 need to be sized to accommodate about 0.8% media expansion. However, it will be recognized that depending on the characteristics of the receiver media 10, and the amount of moisture added to the receiver media 10 by a particular printing application, the maximum amount of media expansion may be larger or smaller than this number.

In an exemplary embodiment where the surface profile 174 of the web-guiding structure 170 is sinusoidal, the surface profile height y of the web-guiding structure as a function of the cross-track position x can be represented in equation form by:

$$y = \frac{h}{2}\sin\left(\frac{2\pi x}{T}\right) \tag{1}$$

where h is the depth of the recesses 172 and T is the period between adjacent ridges 171. (The y=0 surface profile height in this case corresponds to a height halfway between the peaks of the ridges 171 and the recesses 172.)

The slope S of the surface profile 174 as a function of the cross-track position x can be determined by differentiating Eq. (1):

$$S = \frac{dy}{dx} = \frac{\pi h}{T}\cos\left(\frac{2\pi x}{T}\right) \tag{2}$$

The maximum magnitude of the slope $S_{max}$ will occur at the midway points between the peaks of the ridges 171 and the recesses 172, and will be given by:

$$S_{max} = \frac{\pi h}{T} \tag{3}$$

The local radius of curvature R of the surface profile 174 as a function of the cross-track position x can be determined using the well-known formula:

$$R = \frac{\left[1 + \left(\frac{dy}{dx}\right)^2\right]^{3/2}}{\left|\frac{d^2y}{dx^2}\right|} \tag{4}$$

where $d^2y/dx^2$ is the second derivative (i.e., the curvature) of the surface profile 174, which in this example will be:

$$\frac{d^2y}{dx^2} = \left(\frac{-2\pi^2 h}{T^2}\right)\sin\left(\frac{2\pi x}{T}\right) \tag{5}$$

Substituting from Eq. (2) and Eq. (5) into Eq. (4), the local radius of curvature of the sinusoidal surface profile 174 will be given by:

$$R = \frac{\left[1 + \left(\frac{\pi h}{T}\cos\left(\frac{2\pi x}{T}\right)\right)^2\right]^{3/2}}{\left(\frac{2\pi^2 h}{T^2}\right)\left|\sin\left(\frac{2\pi x}{T}\right)\right|} \tag{6}$$

The minimum magnitude of the radius of curvature R (which will correspond to the "sharpest corner") will occur at the peaks of the ridges 171 and the recesses 172, and will be given by:

$$R_{min} = \frac{T^2}{2\pi^2 h} \tag{7}$$

Figure 9:
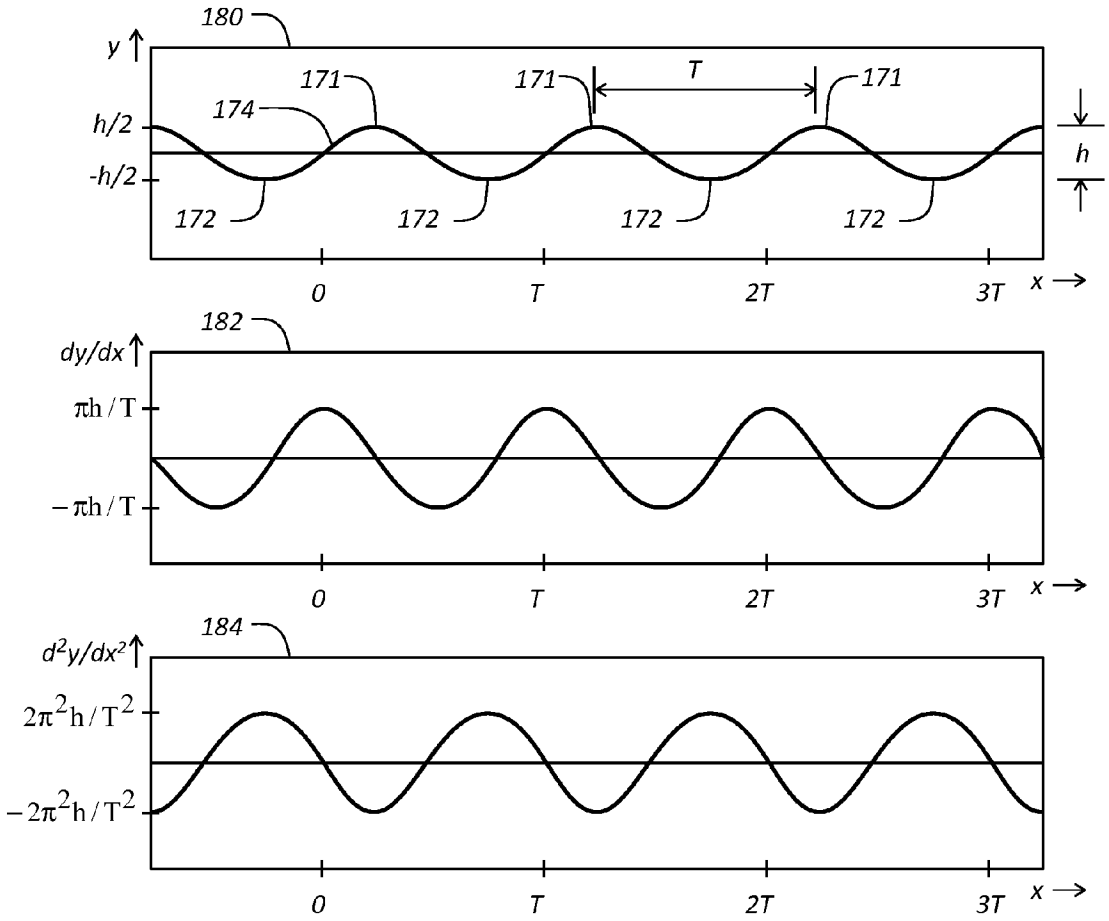
FIG. 9 shows a plot of a sinusoidal surface profile, together with corresponding plots of the slope and curvature.

FIG. 9 shows a plot 180 of the surface profile 174 for the sinusoidal surface of Eq. (1). The amplitude of the sinusoidal function is h/2, giving a total depth h for the recesses 172. A plot 182 of the corresponding first derivative (i.e., slope) given by Eq. (2), and a plot 184 of the corresponding second derivative (i.e., curvature) given by Eq. (5) are also shown in FIG. 9. It can be seen that the maximum magnitudes of the slope occur at the zero crossings in the surface profile 174, and the maximum magnitudes of the curvature occur at the locations of the ridges 171 and recesses 172 in the surface profile 174.

The maximum amount of growth in the cross-track width of the receiver media 10 that can be accommodated by sagging into the recesses 172 in the web-guiding structure 170 will correspond to the path length along the surface profile 174. The path length P along one period T of the surface profile 174 will be given by the well-known formula:

$$P = \int_0^T \sqrt{1 + \left(\frac{dy}{dx}\right)^2}\, dx \tag{8}$$

Substituting for the derivative of the surface profile 174 from Eq. (2) gives:

$$P = \int_0^T \sqrt{1 + \left(\frac{\pi h}{T}\right)^2 \sin^2\left(\frac{2\pi x}{T}\right)}\, dx \tag{9}$$

Letting $\theta = 2\pi x/T$ and solving for the ratio of the path length P to the period T gives:

$$\frac{P}{T} = \frac{1}{2\pi}\int_0^{2\pi} \sqrt{1 + \left(\frac{\pi h}{T}\right)^2 \sin^2(\theta)}\, d\theta \tag{10}$$

This integral can be computed using well-known numerical integration techniques for a given set of surface profile parameters. It can be seen that path length ratio (P/T) is equivalent to the ratio of the path length along the exterior surface 173 of the web-guiding structure 170 divided by the corresponding straight line length of the web-guiding structure 170.

Figure 10:
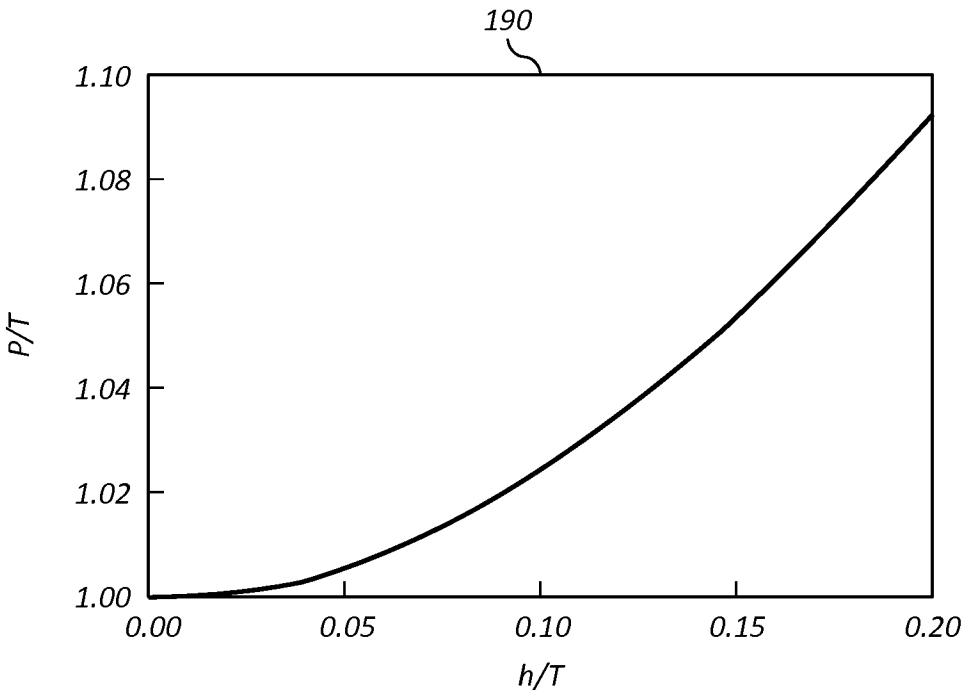
FIG. 10 is a plot showing the path length as a function of the recess depth for a sinusoidal surface profile.

FIG. 10 shows a plot 190 of the path length ratio (P/T) as a function of the recess-depth-to-period ratio (h/T). This can be used to define an appropriate geometry for the surface profile 174 to accommodate the expected amount of expansion for the particular receiver media 10 and printing configuration.

Figure 11:
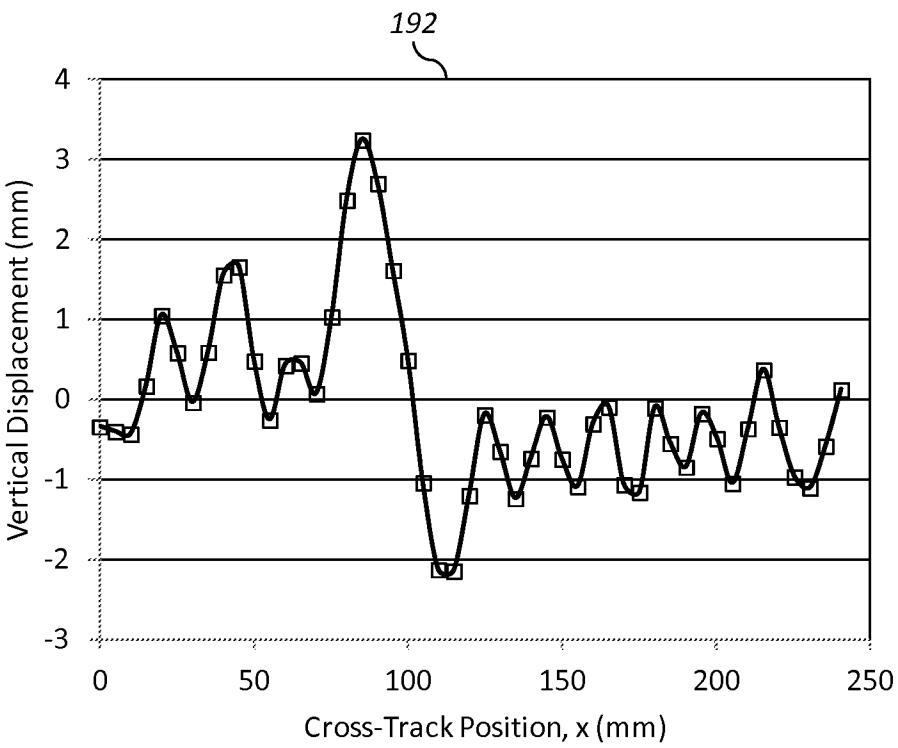
FIG. 11 is a plot showing vertical displacement as a function of cross-track position for an exemplary buckled receiver media.

Inventors have found that the buckles which typically form in a receiver media 10 due to the added moisture content introduced in a printing process tend to occur at a dominant frequency. For example, FIG. 11 shows a plot 192 of an exemplary vertical displacement function showing the vertical displacement determined for a typical receiver media 10 as a function of the cross-track position x for a 21% moisture content. (The exemplary vertical displacement function in this figure was determined analytically using a finite element model of the receiver media 10.) It can be seen that the displacement is approximately periodic over much of the receiver media 10. The dominant frequency can be determined by performing a frequency analysis using any method known to those in the signal processing art. For example, a Fourier transform can be applied to the vertical displacement function to determine a power spectrum. (The vertical displacement function can be determined using any appropriate modeling technique known in the art, or alternatively by measuring real media deformations.) The dominant frequency can be determined by identifying the first mode of the power spectrum.

Figure 12:
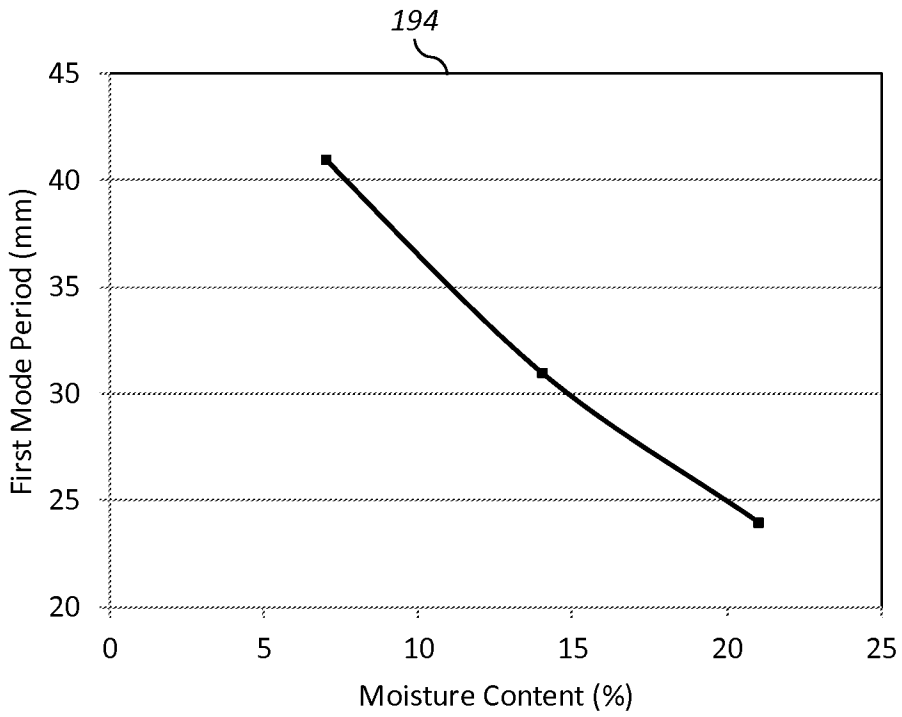
FIG. 12 is a plot of the dominant frequency for buckles formed in an exemplary receiver media as a function of moisture content.

It has been found that the dominant frequency depends on the moisture content of the receiver media 10. Generally, as the moisture content is increased, the Young's modulus of the receiver media 10 decreases, resulting in an increase in the dominant frequency of the resulting flutes. FIG. 12 shows a plot 194 of the first mode period as a function of the moisture content for a typical receiver media 10, where the first mode period $T_d$ is given by:

$$T_d = \frac{1}{f_d} \tag{11}$$

where $f_d$ is the dominant first mode frequency.

In a preferred embodiment, the period T of the surface profile 174 (FIG. 6) is approximately matched to the dominant frequency at a target moisture content level. In this way, the lowest energy state of the deformed receiver media 10 will most naturally conform to the surface profile 174 of the web-guiding structure 170. For example, the period T can be selected to match the first mode period $T_d$ (i.e., the dominant period) to within about 20% at a specified target moisture level. In general thinner, lower basis weight receiver media 10 tend to have lower first mode periods $T_d$ than do thicker, higher basis weight receiver media 10. Uncoated receiver media 10 also tend to have lower first mode periods $T_d$ than do coated receiver media 10. In some configurations, the web-guiding structure 170 will be used for a range of different media types. In this case, it is preferred that the period T of the surface profile 174 match the first mode period $T_d$ of the receiver media 10 that has the highest tendency for rippling or wrinkling.

In an exemplary embodiment, the depth of the recesses is h=1.5 mm, and the period between the ridges is T=25 mm, corresponding to a recess-depth-to-period ratio of h/T=0.060. (This period was selected to approximately match the dominant frequency for a 21% moisture content according to the exemplary media characteristics shown in FIG. 12.) In this case, the maximum slope will be $S_{max}$=0.19 (from Eq. (3), the minimum radius of curvature will be $R_{min}$=21 mm (from Eq. (7)), and the path length ratio will P/T=1.0088 (from Eq. (10)). This surface profile is therefore able to accommodate a 0.88% expansion in the receiver media 10, which is sufficient to handle at least a 21% moisture content for the exemplary media characteristics shown in FIG. 8.

In other embodiments, a wide range of other surface profile parameters can be used depending on the characteristics of the particular receiver media 10 being transported (e.g., stiffness, width, and expected maximum expansion). For example, the depth of the recesses can be in the range of 0.05 mm≤h≤3.0 mm (e.g., to accommodate different maximum media expansion levels), and the period between the ridges can be in the range of 5 mm≤T≤40 mm (e.g., to accommodate different dominant frequencies). Generally, to ensure that creases are not formed in the receiver media 10 as it deforms into the recesses, it will be desirable that the maximum slope ($S_{max}$) should be less than about 0.3, and the minimum radius of curvature ($R_{min}$) should be more than about 5 mm. Typically, the recess-depth-to-period ratio will be in the range of 0.005≤h/T≤0.10. This would correspond to amounts of expansion in the range of 0.006% and 2.4%.

In some embodiments, the web-guiding structure 170 can be used for the print line rollers 31, 32 (FIG. 2) which support the receiver media 10 as it passes the print lines 21, 22 where ink is deposited onto the receiver media 10. In this case, the sagging of the receiver media 10 into the recesses 172 (see FIG. 6) can result in the distance between the print lines 21, 22 and the second side 16 of the receiver media 10 being larger for cross-track positions corresponding to the recesses 172 than it is for cross-track positions corresponding to the ridges 171. Thus, the time of flight for the ink drop to reach the receiver media 10 will also be correspondingly larger. Since the web of receiver media 10 will generally be continuously moving during the printing process, this can cause the ink drops over the recesses 172 to be shifted in the in-track direction 4 (FIG. 2) relative to the ink drops over the ridges 171.

In a preferred embodiment, the depth h of the recesses 172 is constrained to be less than the amount that will result in a one pixel alignment error in the ink drop position for web-guiding structures 170 that are used in this location. In other embodiments, it may be desirable to use a tighter constraint (e.g., a ½ pixel offset). It can be shown that the amount of in-track displacement $\Delta x_i$ for a given recess depth h will be:

$$\Delta x_i = \frac{V_w}{V_d} h \tag{12}$$

where $V_w$ is the velocity of the web of receiver media 10 and $V_d$ is the velocity of the ink drop. To ensure that the in-track displacement $\Delta x_i$ is less than one pixel, the recess depth h should be limited to:

$$h \le \frac{V_d}{V_w} \Delta x_p = \frac{V_d}{V_w} \frac{1}{f_p} \tag{13}$$

where $\Delta x_P$ is the pixel size, which will be given by $1/f_P$, where $f_P$ is the pixel frequency of the printer. For example, for the case of a printer where $f_p$=900 dpi, $V_w$=3.3 m/s and $V_d$=14 m/s, the maximum depth h to ensure that the in-track displacement is less than one pixel would be 0.12 mm. In an exemplary embodiment, h=0.10 mm and T=10 mm. This design is able to accommodate a media expansion of 0.025% during the time that the receiver media 10 is in contact with the web-guiding structure 170. While this number is relatively small, the amount of time that the receiver media 10 is in contact with the web-guiding structure 170 is quite small due to the small wrap angle. Furthermore, the susceptibility of the receiver media 10 to forming wrinkles is relatively small for small wrap angles because the associated lower folding forces on the receiver media 10 reduce the likelihood that ripples will crease into wrinkles.

In the exemplary embodiment shown in FIGS. 5-6, the ridges 171 of the surface profile 174 are shown as with a constant outer diameter so that an envelope around the exterior surface 173 has a uniform diameter. However, this is not a requirement. In some embodiments, it can be desirable that the diameter of the surface envelope varies as a function of the cross-track position.

Figure 13A:
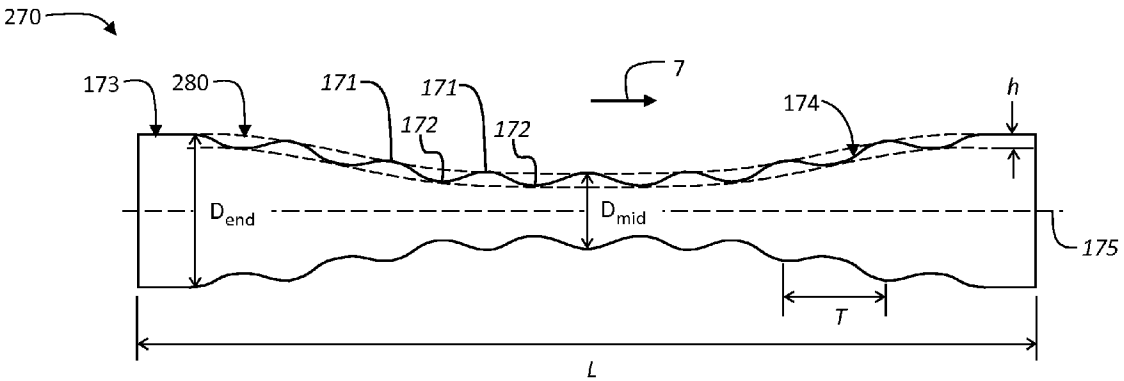
FIG. 13A is a side view of a web-guiding structure whose ridges provide a concave surface profile.
Figure 13B:
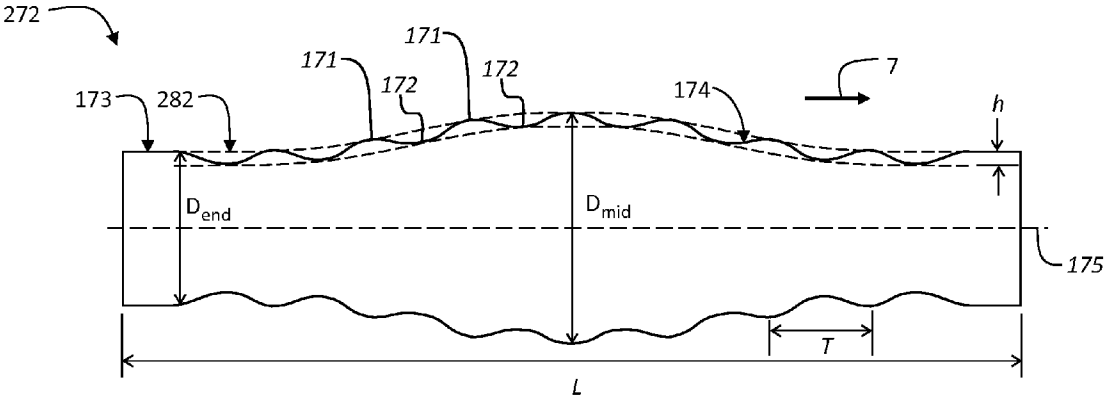
FIG. 13B is a side view of a web-guiding structure whose ridges provide a convex surface profile.

FIG. 13A shows a side view of an exemplary web-guiding structure 270 where the outer diameter of the ridges 171 is varied to provide a concave surface envelope 280, while FIG. 13B shows a side view of another exemplary web-guiding structure 272 where the diameter of the ridges 171 is varied to provide a convex surface envelope 282. Within the context of the present disclosure, the surface envelope is a curve formed by joining the peaks of successive ridges 171 along the surface profile 174.

For both web-guiding structures 270, 272 the depth h of the recesses 172 relative to the corresponding surface envelope is constant, although this is not required. For the concave surface envelope 280 of the web-guiding structure 270 in FIG. 13A, the diameters ($D_{end}$) of the ridges 171 near the ends of the web-guiding structure 270 are larger than the diameters ($D_{mid}$) of the ridges 171 near a middle of the web-guiding structure 270. For the convex surface envelope 282 of the web-guiding structure 272 of FIG. 13B, the diameters ($D_{end}$) of the ridges 171 near the ends of the web-guiding structure 272 are smaller than the diameters ($D_{mid}$) of the ridges 171 near the middle of the web-guiding structure 272.

It is known that a rotating roller having a contoured surface profile (as in concave surface envelope 280 of FIG. 13A and the convex surface envelope 282 of FIG. 13B) can provide lateral forces on the web of receiver media 10 to spread or stretch the web of receiver media 10 in the cross-track direction 7, thereby helping to reduce susceptibility to media wrinkling as a result of cross-track expansion due to absorption of water-based ink. The appropriate shape of the surface profile will depend on the fraction of the receiver media 10 around the web-guiding structure 70. The amount of traction will depend on a variety of factors including the surface properties of the web-guiding structure 270, 272 and the receiver media 10, the tension of the receiver media 10, and the wrap angle $\alpha$ (FIG. 7). A concave surface envelope 280 (as in FIG. 13A) is generally appropriate for high-traction configurations (e.g., for wrap angles $\alpha$ that are larger than about 10 degrees), and a convex surface envelope 282 (as in FIG. 13B) is generally appropriate for low-traction configurations (e.g., for wrap angles $\alpha$ that are only a few degrees).

The amount of concavity shown for the concave surface envelope 280 in FIG. 13A and the amount of convexity shown for the convex surface envelope 282 in FIG. 13B are exaggerated to larger than typical values for illustrative purposes. Typically, the amount of concavity or convexity would be smaller than the illustrated values. In an exemplary embodiment, a concave web-guiding structure 270 of the type shown in FIG. 13A has a length of 685 mm and a concave surface envelope 280 where $D_{end}$ is 0.90 mm larger than $D_{mid}$. In other embodiments, the amount of concavity or convexity can be smaller or larger, for example in the range $|D_{end}-D_{mid}|\leq 2.0$ mm. Generally, the appropriate amount of concavity or convexity will be proportional to the roller length L. Typically, $|D_{end}-D_{mid}|/L\leq 0.5\%$.

Figure 14B:
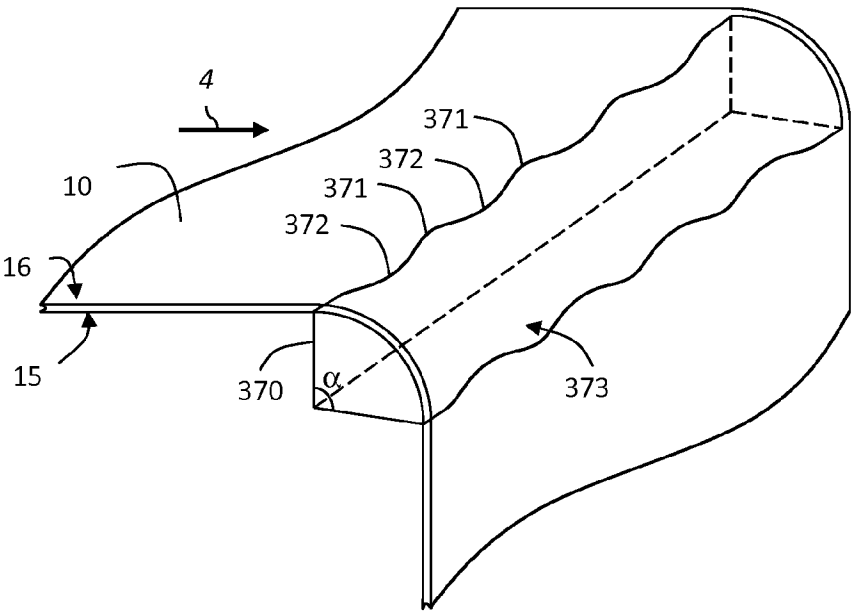
FIG. 14B is a perspective diagram of the fixed web-guiding structure of FIG. 14A.
Figure 14A:
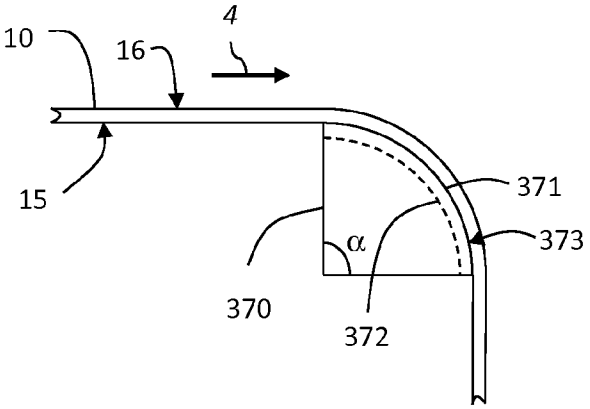
FIG. 14A is an end view of a fixed web-guiding structure according to an alternate embodiment.

FIGS. 14A-14B show an example of a non-rotating, fixed web-guiding structure 370 similar to the web-guiding structure 170 shown in FIGS. 6-7, but where the fixed web-guiding structure 370 does not rotate, and in this example has a non-circular cross-section. In other embodiments (not shown), the fixed web-guiding structure 370 can have other shapes. For example, it can have a circular cross-section (i.e., it can be a non-rotating roller). In the illustrated embodiment, the exterior surface 373 of the fixed web-guiding structure 370 faces the first side 15 of the web of receiver media 10 has an arc-shaped cross-section, and has a pattern of alternating ridges 371 and recesses 372 across the width of the receiver media 10. In this example, the recesses 372 are grooves that extend around the exterior surface 373 in a direction parallel to the in-track direction 4 of the receiver media 10.

With the fixed web-guiding structure 370, the web of receiver media 10 will slide past the exterior surface 373 in contact with the ridges 371. Consequently, such configurations are most appropriate for cases where the fixed web-guiding structure 370 contacts a non-printed side of the receiver media 10. (For cases where a printed side of the receiver media 10 contacts the exterior surface 373 before the ink has fully dried, it will generally be preferable to use a rotating web-guiding structure 170, such as that shown in FIG. 6.)

In order to reduce drag on the web of receiver media 10 and improve the wear resistance of the fixed web-guiding structure 370, the exterior surface 373 is preferably fabricated using a material having a coefficient of friction that is less than 0.2. In some embodiments, the fixed web-guiding structure 370 can be made entirely of a low friction material such as polytetrafluoroethylene (also known as PTFE or by its trademarked name of TEFLON). Alternatively, the fixed web-guiding structure 370 can be made of a material such as stainless steel and the exterior surface can be polished and coated with a low friction material such as PTFE or thin film diamond-like carbon.

In some embodiments, the exterior surface 373 of the fixed web-guiding structure 370 can be an air bearing surface having a plurality of holes (not shown in FIGS. 14A-14B) though which air flows to cause the receiver media 10 to at least partially float on a cushion air between the receiver media 10 and the exterior surface 373 of the fixed web-guiding structure 370.

It will be obvious to one skilled in the art that in addition to guiding receiver media 10 through a printing system 100, the media guiding systems of the present invention can also be used to guide other types of media in other types of media transport systems. For example, the present invention can also be used to move various kinds of substrates through other types of systems such as media coating systems, or systems for performing various media finishing operations (e.g., slitting, folding or binding).

The invention has been described in detail with particular reference to certain preferred embodiments thereof, but it will be understood that variations and modifications can be effected within the spirit and scope of the invention.

PARTS LIST

2 roller
3 receiver media
4 in-track direction
5 flute
7 cross-track direction
8 contact surface
9 exit direction
10 receiver media
11 source roll
12 take-up roll
15 first side
16 second side
17 receiver media portions
18 receiver media portions
20*a* printhead
20*b* printhead
20*c* printhead
20*d* printhead
21 print line
22 print line
25*a* printhead
25*b* printhead
30 web-guiding system
31 print line roller
32 print line roller
40 dryer
41 dryer roller
45 quality control sensor
50 printing module
51 first zone
52 second zone
55 printing module
60 turnover mechanism
65 printing module
66 web-guiding structure
70 web-guiding structure
71 ridge
72 recess
73 exterior surface
75 rotation direction
100 printing system
110 printing system
170 web-guiding structure
171 ridge
172 recess
173 exterior surface
174 surface profile
175 axis

176 entry contact boundary
177 exit contact boundary
180 plot
182 plot
184 plot
186 plot
190 plot
192 plot
194 plot
270 web-guiding structure
272 web-guiding structure
280 concave surface envelope
282 convex surface envelope
370 fixed web-guiding structure
371 ridge
372 recess
373 exterior surface
d diameter
D outer diameter
$D_{end}$ outer diameter
$D_{mid}$ outer diameter
h depth
L length
P path length
R radius of curvature
$R_{min}$ minimum radius of curvature
S slope
$S_{max}$ maximum slope
T period
x cross-track position
y surface profile height
$\alpha$ wrap angle
$\theta$ scaled cross-track position

The invention claimed is:

1. A web-guiding system for guiding a web of media having a width spanning a cross-track direction travelling from upstream to downstream along a transport path in an in-track direction, the web of media having a first side and an opposing second side, comprising:

a web-guiding structure including an exterior surface having a pattern of alternating ridges and recesses formed into the exterior surface, wherein the web of media travels past the web-guiding structure with the first side of the web of media contacting at least some of the ridges on the exterior surface of the web-guiding structure;

wherein the ridges and recesses are formed into the exterior surface of the web-guiding structure such that the exterior surface has a continuous and smooth surface profile in the cross-track direction, the surface profile having a maximum slope magnitude of no more than 0.3 and a minimum radius of curvature magnitude of no less than 5 mm.

2. The web-guiding system of claim 1 wherein the slope of the surface profile varies continuously.

3. The web-guiding system of claim 1 wherein a direction of travel of the web of media is redirected by at least 1 degree as it travels along the transport path past the web-guiding structure.

4. The web-guiding system of claim 1 wherein the web-guiding structure is a rotating roller.

5. The web-guiding system of claim 4 wherein the roller is a print-line roller used to support the receiver media as it passes by a print line of an inkjet print head adapted to deposit drops of ink on the receiver media, the roller being positioned on an opposite side of the receiver media from the print head.

6. The web-guiding system of claim 5 wherein a depth of the recesses is selected so that any additional flight time associated with the ink drops that are deposited onto portions of the receiver media that sag into the recesses produces alignment errors of less than one pixel relative to the drops of ink deposited onto portions of the receiver media over the ridges, the flight time being the time that it takes the ink drops to travel from the print head to the receiver media.

7. The web-guiding system of claim 4 wherein a surface envelope formed by joining peaks of successive ridges along the surface profile has a diameter that varies along a length of the roller to provide a convex or a concave surface envelope shape.

8. The web-guiding system of claim 1 wherein the exterior surface of the web-guiding structure is provided by a fixed media support having a surface facing the web of media.

9. The web-guiding system of claim 8 wherein the exterior surface of the fixed media support has an arc-shaped cross-section.

10. The web-guiding system of claim 8 wherein the exterior surface of the fixed media support has a circular cross-section.

11. The web-guiding system of claim 8 wherein the exterior surface is fabricated using a material having a coefficient of friction less than 0.2.

12. The web-guiding system of claim 1 wherein a cross-track distance between peaks of adjacent ridges is substantially constant along a length of the web-guiding structure.

13. The web-guiding system of claim 1 wherein a cross-track distance between peaks of adjacent ridges is between 5 mm and 50 mm.

14. The web-guiding system of claim 1 wherein a cross-track distance between peaks of adjacent ridges matches a dominant period of buckles formed in the receiver media to within 20% for specified target moisture content.

15. The web-guiding system of claim 1 wherein a depth of the recesses is between 0.05 mm and 3.0 mm.

16. The web-guiding system of claim 1 wherein a path length along the surface of the web-guiding structure is more than 0.25% longer than a corresponding straight line length of the web-guiding structure.

17. The web-guiding system of claim 1 wherein a ratio of a depth of the recesses to a distance between adjacent ridges and is between 0.005 and 0.10.

18. The web-guiding system of claim 1 wherein the surface profile is a sinusoidal surface profile.

* * * * *